US007198019B1

(12) United States Patent
Belter

(10) Patent No.: US 7,198,019 B1
(45) Date of Patent: Apr. 3, 2007

(54) LUBRICATING SYSTEM FOR A MARINE ENGINE

(75) Inventor: David J. Belter, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/175,826

(22) Filed: Jul. 6, 2005

(51) Int. Cl.
*F01M 1/00* (2006.01)

(52) U.S. Cl. ..... 123/196 R

(58) Field of Classification Search ..... 123/196 R, 123/196 W, 195 C, 195 H, 195 R
See application file for complete search history.

(56) References Cited

U.S. PATENT DOCUMENTS 4,771,745 A * 9/1988 Nakamura et al. ..... 123/196 R
5,452,692 A * 9/1995 Spray et al. ..... 123/195 C
5,687,686 A 11/1997 Takahashi
6,076,495 A 6/2000 Takahashi et al.
6,286,476 B1 9/2001 Hiraoka et al.

* cited by examiner

*Primary Examiner*—Stephen K. Cronin
*Assistant Examiner*—Hyder Ali
(74) *Attorney, Agent, or Firm*—William D. Lanyi

(57) ABSTRACT

A lubricating system for a marine engine provides a lubrication deflector which extends from the cylinder block of the engine toward rotating surfaces of a crankshaft and/or connecting rod. A lubrication passage is provided as an integral part of a cylinder block of the marine engine to direct a flow of liquid lubricant away from the lubrication deflectors and downwardly toward a lubrication reservoir, or sump.

23 Claims, 6 Drawing Sheets

LUBRICATING SYSTEM FOR A MARINE ENGINE

BACKGROUND OF THE INVENTION

1. Field of the Invention

The present invention is generally related to a lubrication system for a marine engine and, more particularly, to a system in which an oil scraper, or oil deflector, is located in the cylinder block portion of a crankcase to remove oil from the proximate rotating surfaces of a crankshaft and connecting rod.

2. Description of the Related Art

Oil that is used to lubricate sliding surfaces associated with an engine is eventually drained to a collection reservoir, such as an oil sump. As the oil flows in the region of the crankshaft of the engine, it is moved at relatively high speed in conjunction with the rapidly rotating surfaces of the crankshaft. The presence of liquid oil in the environment within the crankcase can have a deleterious effect on the efficiency of the engine. This is particularly true in marine engines, where a vertical crankshaft may have numerous counterweights and other elements rotating about its center line past which the liquid oil must pass as it flows downwardly toward the oil sump of the marine engine.

U.S. Pat. No. 5,687,686, which issued to Takahashi on Nov. 18, 1997, describes a lubricating system for a four cycle outboard motor. It embodies an improved lubricating system. The lubricating system drains oil from the cylinder head back to the oil tank, in a manner so as to not add to the length of the engine. In addition, an improved crankcase ventilating system is employed that incorporates a simple baffle arrangement for insuring that oil thrown by the crankshaft rotation will not pass through the ventilating passage into the cylinder head or escape from the ventilating system.

U.S. Pat. No. 6,076,495, which issued to Takahashi et al. on Jun. 20, 2000, describes a bearing arrangement for a vertical engine. The crankshaft rotates within a crankcase chamber defined by the cylinder block and a crankcase cover connected thereto. First web members which support half bearings extend from the cylinder block. Mating half bearings are supported by second web members positioned opposite the first web members. An oil flow passage is defined through the crankcase chamber generally opposite the cylinder block from a top end to a bottom end of the chamber. In one arrangement, the oil flow passage comprises individual passages through the second web members. In another arrangement, the oil flow passage comprises a space between an end of the second web members opposite the cylinder block and the crankcase cover. The crankshaft support arrangement allows lubricating oil introduced into the crankcase chamber to flow downwardly from the top end to the bottom end of the chamber for return to an oil reservoir for recirculation through the engine.

U.S. Pat. No. 6,286,476, which issued to Hiraoka et al. on Sep. 11, 2001, describes an engine lubricating system. The crankshaft rotates within a crankcase chamber defined by the cylinder block and a crankcase cover connected thereto. A baffle plate is positioned in the crankcase chamber between the crankcase cover and the crankshaft. At least one oil flow passage is defined through the crankcase chamber from a top end to a bottom end of the chamber. In one embodiment, oil is supplied through a main passage in the crankcase cover and a branch passage through each second crankshaft support members for lubricating the bearings.

The patents described above are hereby expressly incorporated by reference in the description of the present invention.

In certain applications of marine engines, it is impractical to provide components within the crankcase cover for the purpose of directing liquid lubricant away from the crankshaft and downwardly toward an oil reservoir, or sump. It would therefore be significantly beneficial if a marine engine could be provided which performs these functions without requiring direct involvement of the crankcase cover. This would allow the strength and stiffness of the crankcase cover to be independent of the potential adverse affects that could result from the necessity of providing oil deflectors and lubricant passages within the structure of the crankcase cover.

SUMMARY OF THE INVENTION

A lubricating system for a marine engine made in accordance with a preferred embodiment of the present invention comprises a cylinder block, a crankcase cover which is attachable to the cylinder block to define a crankcase therebetween, a first crankshaft supporting member extending from the cylinder block, a second crankcase supporting member extending from the crankcase cover, a crankshaft supported by the first and second crankshaft supporting members for rotation about a generally vertical axis of rotation, and a deflector that extends from the cylinder block toward a rotatable surface of the crankshaft. A distal end of the deflector is disposed proximate the rotatable surface of the crankshaft and configured to direct a flow of lubricant away from the rotatable surface of the crankshaft.

In a preferred embodiment of the present invention, the deflector is formed as an integral part of the cylinder block. The present invention, in a preferred embodiment, can further comprise a lubricant passage configured to conduct a flow of lubricant downwardly from a region of the deflector. This lubricant can be conducted downwardly toward an oil reservoir or sump. The lubricant passage is preferably formed as an integral portion of the cylinder block. The deflector is formed between the first crankshaft supporting member and the lubricant passage in a preferred embodiment of the present invention. The deflector can be configured to direct the flow of lubricant toward and into the lubricant passage so that the lubricant can be directed downwardly.

In a preferred embodiment of the present invention, a first portion of the distal end of the deflector is disposed proximate a first path traveled by a rotatable surface of a counterweight of the crankshaft as the crankshaft rotates about the generally vertical axis of rotation. A second portion of the distal end of the deflector can be disposed proximate a second path traveled by a surface of a connecting rod attached to the crankshaft.

In a preferred embodiment of the present invention, in which a plurality of first and second crankshaft supporting members are used, a plurality of deflectors are provided in which each of the deflectors is disposed between an associated pair of adjacent ones of the first plurality of crankshaft supporting members within the cylinder block. Each of the plurality of deflectors is located generally between the rotatable surfaces of the crankshaft and the lubricant passage.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
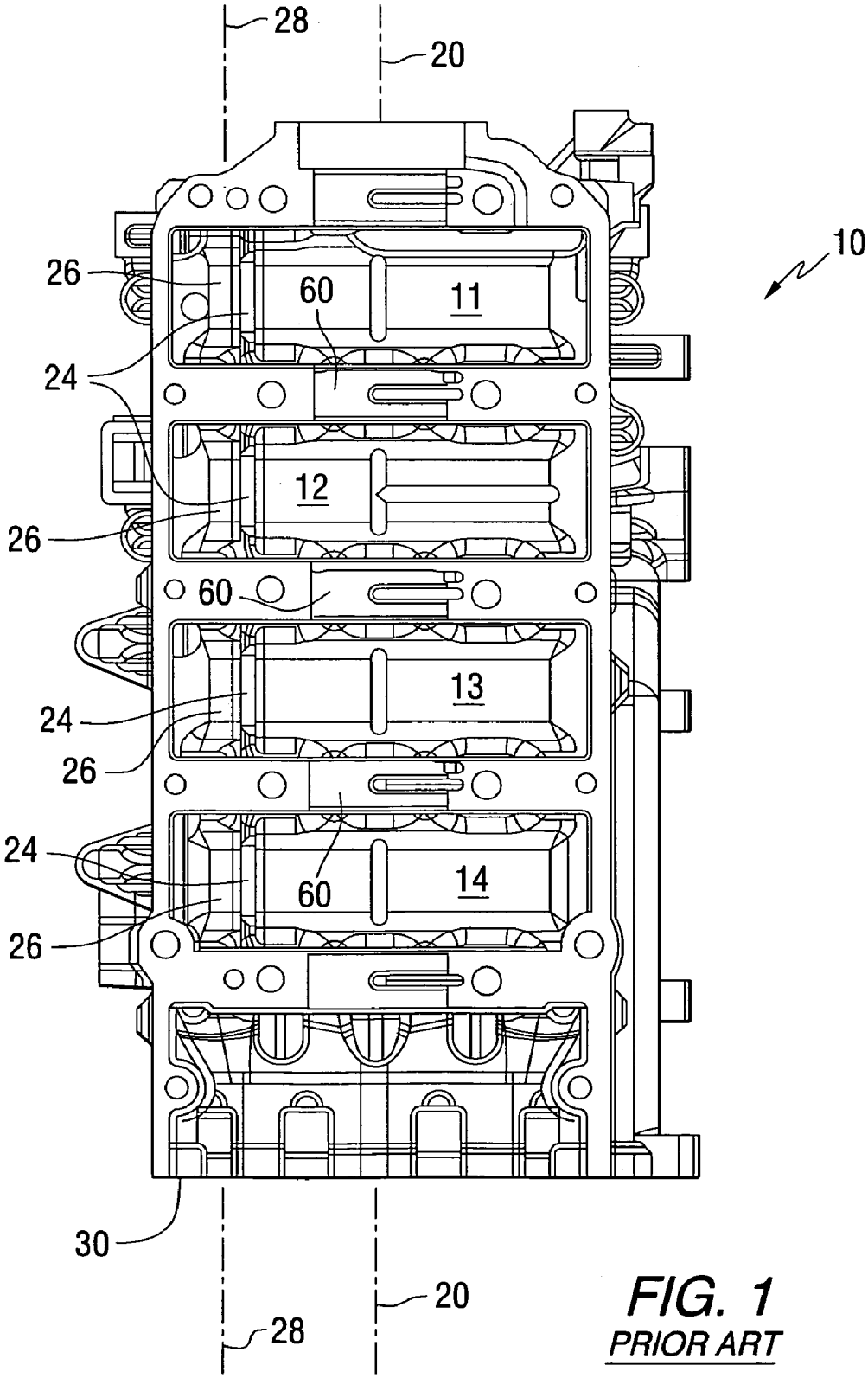
FIG. 1 PRIOR ART
FIG. 1 shows a known type of crankcase cover.

Throughout the description of the preferred embodiment of the present invention, like components will be identified by like reference numerals.

Those skilled in the art of marine engine design are generally familiar with the use of oil deflectors, or scrapers, to direct a flow of lubricant away from a rotating crankshaft and toward a drain passage which directs the liquid lubricant toward an oil reservoir, or sump. These components are normally provided as a part of a crankcase cover. However, locating the lubricant deflector, or scraper, and the lubricant passage, or drain channel, in the crankcase cover can be significantly problematic when the crankcase cover is manufactured by the process of die casting. These components of the lubrication system are more easily incorporated in the crankcase cover when the crankcase cover is manufactured by the use of lost foam casting processes. Therefore, if a marine engine is intended to incorporate a crankcase cover made by the die casting process, the provision of the lubricant deflectors and lubricant passage in the crankcase cover should preferably be avoided because of the potential deleterious results that could cause a disadvantageous lack of stiffness and rigidity in the structure of the crankcase cover.

FIG. 1 illustrates a crankcase cover 10 which is generally known to those skilled in the art. In the regions identified by reference numerals 11–14, counterweight structures of a crankshaft rotate about center line 20. As is generally known to those skilled in the art, a crankcase cover 10, such as the one shown in FIG. 1, is attached to a cylinder block to define a crankcase chamber therebetween. To direct liquid lubricant away from a crankshaft which is rotating about center line 20, lubricant deflectors 24 are provided. The lubricant deflectors 24 are intended to separate the liquid lubricant from the crankshaft and direct the liquid lubricant into a lubricant channel 26 downwardly, along line 28, toward an oil reservoir located below the bottom surface 30 of the crankcase cover 10. The lubricant deflectors 24 and the lubricant passage 26 are formed as integral portions of the crankcase cover 10 in typical applications of this type of lubricant management system.

Figure 2:
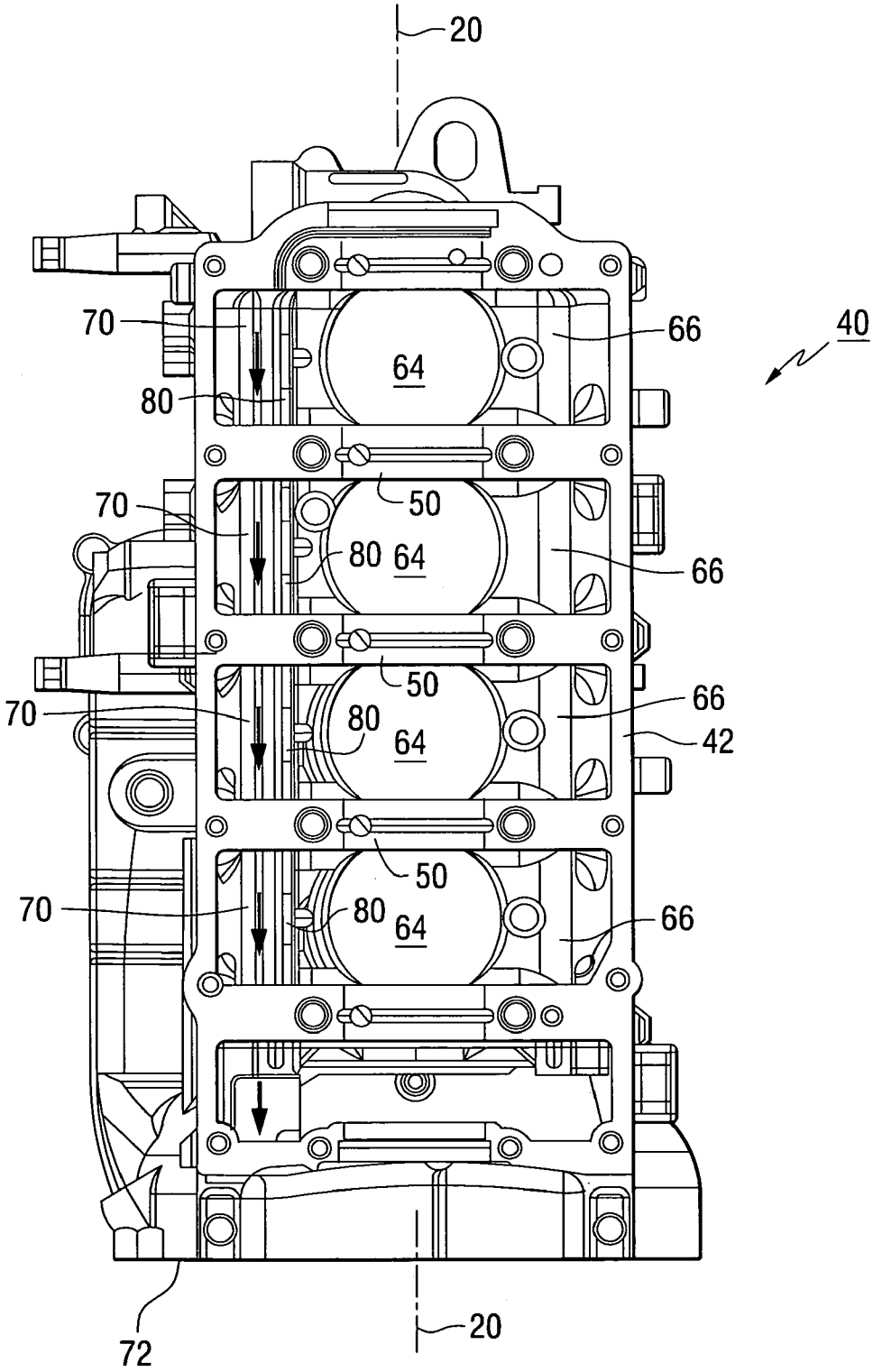
FIG. 2 is a view of a cylinder block incorporating the present invention.

FIG. 2 shows a cylinder block 40 of a marine engine which incorporates a preferred embodiment of the present invention. Although not shown in FIG. 2, it should be understood that a crankcase cover is intended to be attached to surface 42 to enclose a crankcase chamber between the crankcase cover and the cylinder block 40. FIG. 1 shows a known type of crankcase cover 10. However, it should be understood that a crankcase cover used in conjunction with the cylinder block 40 shown in FIG. 2 would not necessarily incorporate, within its structure, a lubricant deflector 24, or scraper, or a lubricant passage 26 used as a drain conduit to direct liquid lubricant downwardly through the crankcase cover.

With continued reference to FIG. 2, first crankshaft supporting members 50 extend from the cylinder block 40. Second crankshaft supporting members 60, generally similar to those shown in FIG. 1, extend from the crankcase cover. The use of first and second crankshaft supporting members, 50 and 60, extending from the cylinder block 40 and crankcase cover 10, respectively, are generally known to those skilled in the art of marine engine design. A crankshaft, which is not shown in FIG. 2, is supported for rotation about a vertical axis 20 by the cooperative effort of the first and second crankshaft supporting members, 50 and 60, which are shaped to support bearings therebetween. These bearings, in turn, support the crankshaft for rotation about vertical axis 20.

With continued reference to FIG. 2, four cylinders 64 are illustrated. Pistons of the marine engine would be located within the cylinder 64 for reciprocal motion, along axes generally perpendicular to the drawing of FIG. 2, as is well known to those skilled in the art. The cavities 66 formed in the cylinder block 40 are intended to provide a space within which the counterweights of a crankshaft can rotate. In addition, the portion of the connecting rods attached to the crankshaft also rotate within cavities 66.

A lubricant passage 70 is provided to direct a flow of liquid lubricant downwardly, as represented by the arrows in FIG. 2, towards an oil reservoir region below the bottom surface 72 of the cylinder block 40. Lubricant deflectors 80 extend from the cylinder block 40 toward rotatable surfaces of the crankshaft, as will be described in greater detail below. In a preferred embodiment of the present invention, the deflectors are formed as integral parts of the cylinder block 40. In addition, in a preferred embodiment of the present invention, the lubricant passage 70, which serves as a drain conduit for the liquid lubricant, is formed as an integral passage within the structure of the cylinder block 40. The deflectors 80 are preferably formed between the first crankshaft supporting members 50 and the lubricant passage 70. The deflectors 80 are configured to direct the flow of liquid lubricant toward the lubricant passage 70.

Figure 3:
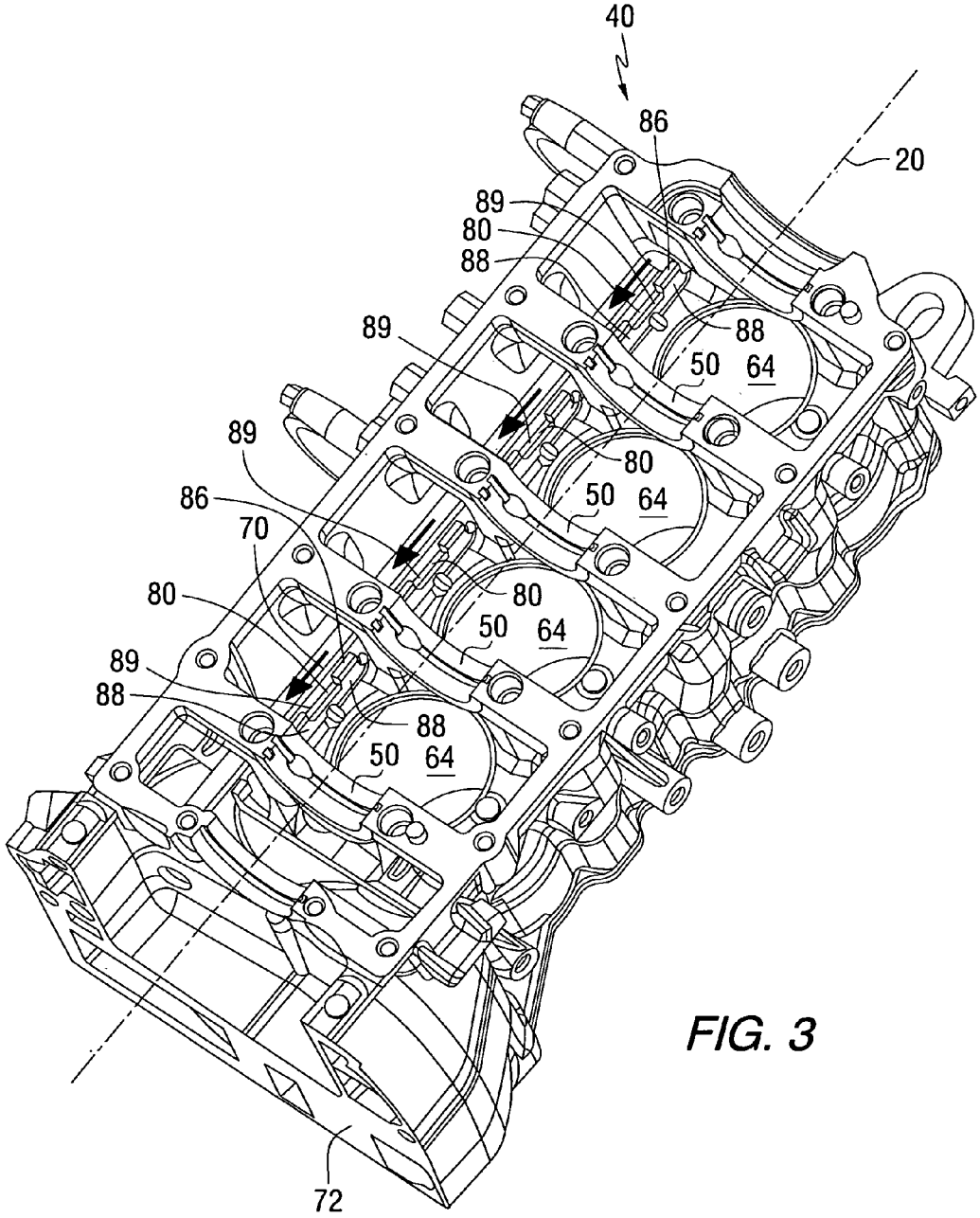
FIG. 3 is an isometric view of the cylinder block shown in FIG. 2.

FIG. 3 shows an isometric view of the cylinder block 40 described above in conjunction with FIG. 2. As can be seen, each of the plurality of deflectors 80 is disposed between an associated pair of adjacent crankshaft supporting members 50. As in FIG. 2, the arrows in FIG. 3 represent the downward flow of liquid lubricant within the lubricant passage 70 after the liquid lubricant is separated, by the lubricant deflectors 80, from a crankshaft which is rotating about axis 20.

With continued reference to FIG. 3, each of the plurality of deflectors 80 has a distal end 86 which extends in a direction away from the cylinder block 40 where the lubricant deflectors 80 are attached to or formed as an integral part of the cylinder block 40. These distal ends 86, in a preferred embodiment of the present invention, comprise first and second portions, identified by reference numerals 88 and 89 in FIG. 3. The first portions 88 are formed as the upper and lower ends of the liquid deflectors 80 and the second portion 89 is formed between the first portions 88 of each deflector 80. The first portion 88 of each of the distal ends 86 of the plurality of deflectors 80 is disposed proximate a first path traveled by an associated counterweight of the crankshaft as the crankshaft rotates about the generally vertical axis of rotation 20. The second portion of each of the distal ends of the plurality of deflectors 80 is disposed proximate a second path traveled by an associated connecting rod attached to the crankshaft as the crankshaft rotates about the generally vertical axis of rotation 20. Although not a necessary feature in all embodiments of the present invention, the first and second portions, 88 and 89, of the liquid deflectors 80 serve to improve the removal of lubricant away from their respective rotating surfaces of the crankshaft and direct the flow of the liquid lubricant into the lubricant passage 70.

In a preferred embodiment of the present invention, each of the plurality of the deflectors 80, or scrapers, is formed as an integral part of the cylinder block 40. In a particularly preferred embodiment of the present invention, these lubricant deflectors 80 and the cylinder block 40 are formed through the use of the lost foam casting process. Similarly, the lubricant passage 70 is formed as an integral part of the cylinder block 40 through the same manufacturing process.

Figure 4:
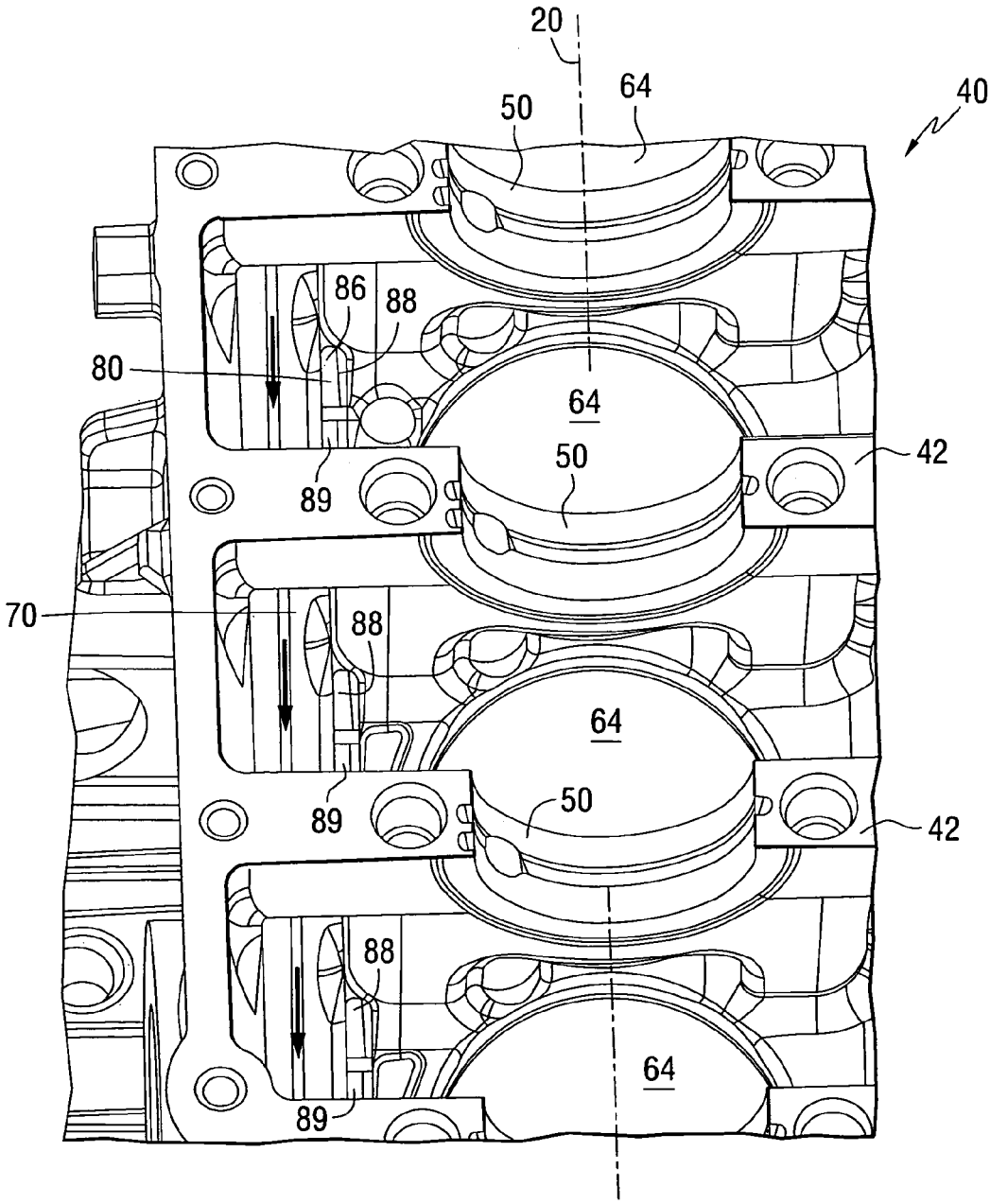
FIG. 4 is a partial isometric view of a cylinder block incorporating the present invention.

FIG. 4 is a partial isometric view of the illustration shown in FIGS. 2 and 3. As illustrated, between each of the adjacent pairs of the plurality of first crankshaft supporting members 50, one of the lubricant deflectors 80 extend from the structure of the cylinder block 40. In FIG. 4, the distal end 86 of the lubricant deflector 80 is shown having a first portion 88 and a second portion 89. In the embodiment shown in FIGS. 2–4, the second portion 89 appears as a notch or gap between two first portions 88. In FIG. 4, because of the isometric nature of the illustration, only one of the first portions 88 is visible for each of the lubricant deflectors 80. As a crankshaft rotates about the axis of rotation 20, the lubricant deflector 80 separates some of the liquid lubricant that is rotating with the crankshaft and directs that flow of liquid lubricant into the liquid passage 70 so that it can be drained, in the direction represented by the arrows in FIG. 4, downwardly into a lubricant reservoir or sump.

Figure 5:
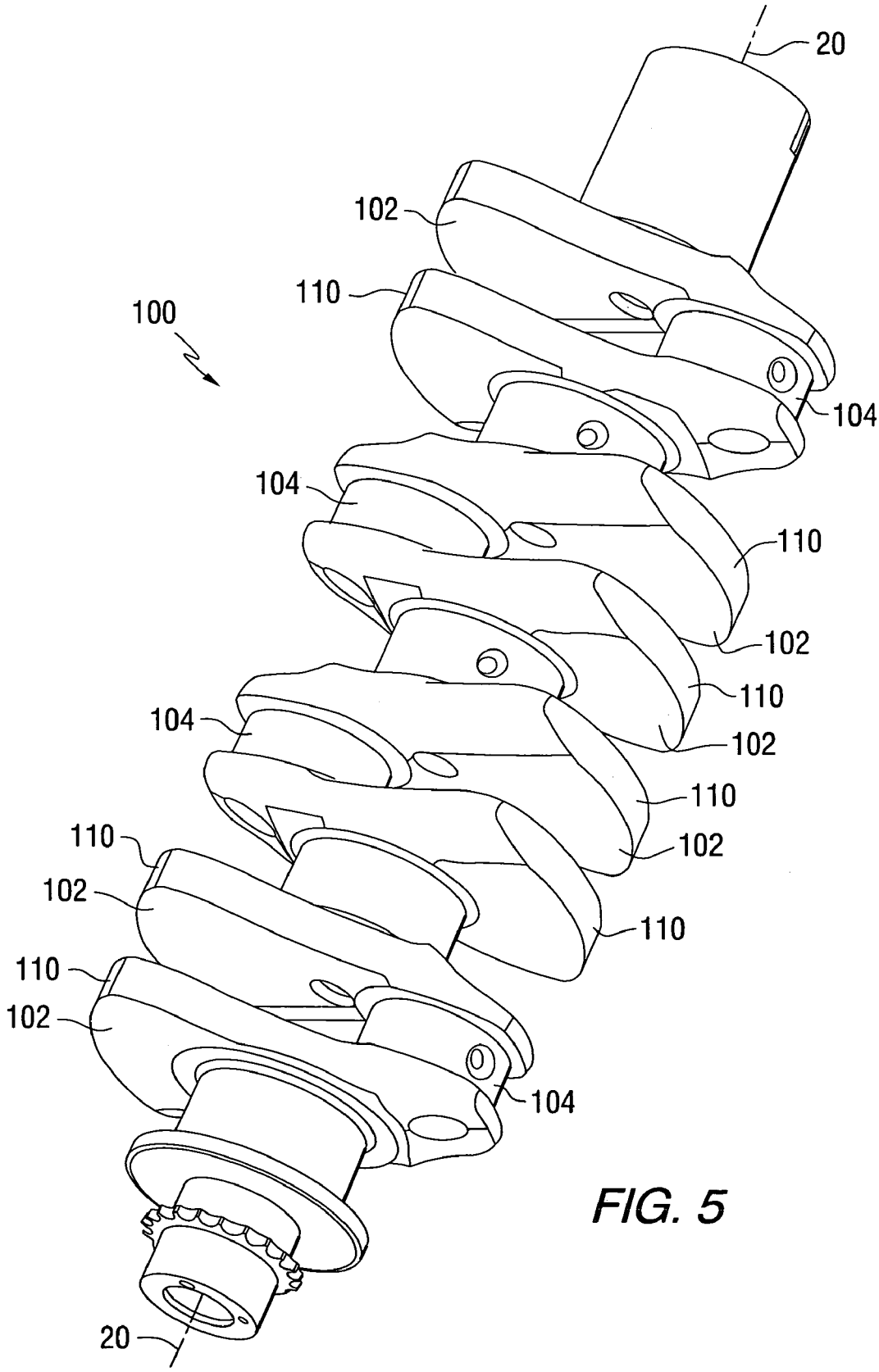
FIG. 5 shows a crankshaft that can be used in conjunction with a marine engine incorporating the present invention.

FIG. 5 is an isometric view of a crankshaft that can be incorporated with the cylinder block 40 described above in conjunction with a preferred embodiment of the present invention. Although the precise shape and configuration of the crankshaft 100 is not limiting to the present invention, several elements of the crankshaft relate to structures of a preferred embodiment of the present invention. These will be described in conjunction with FIG. 5.

In FIG. 5, the crankshaft 100 is shown with four pairs of counterweights 102 and four attachment locations 104 where connecting rods can be attached to the crankshaft 100. Surfaces 110 of the counterweights travel along a generally circular path which passes an associated lubrication deflector 80, such as those described above. Liquid lubrication traveling with the crankshaft and, more particularly, with the rotating surfaces 110, can be separated by the distal end 86 of the lubrication deflector 80 and, more particularly, by the first portion 88 of the distal ends. That liquid lubrication is then directed toward the lubrication passage 70 in the manner described above. A portion of a connecting rod (not shown in FIG. 5) attached to the attachment location 104 passes the second portion 89 of the distal ends 86 of an associated lubrication deflector 80. Similarly, liquid lubrication is separated from that surface and directed toward the lubrication passage.

It should be understood that the specific relationship between surfaces 110 and the lubrication deflector 80 are provided for purposes of describing an exemplary embodiment of a present invention and are not limiting to all other embodiments. Similarly, it should be understood that the path traveled by the most proximate surface of a connecting rod attached to attachment location 104 is not precisely a circular path because of the rocking nature of the connecting rod as the crankshaft rotates about its axis 20.

Figure 6:
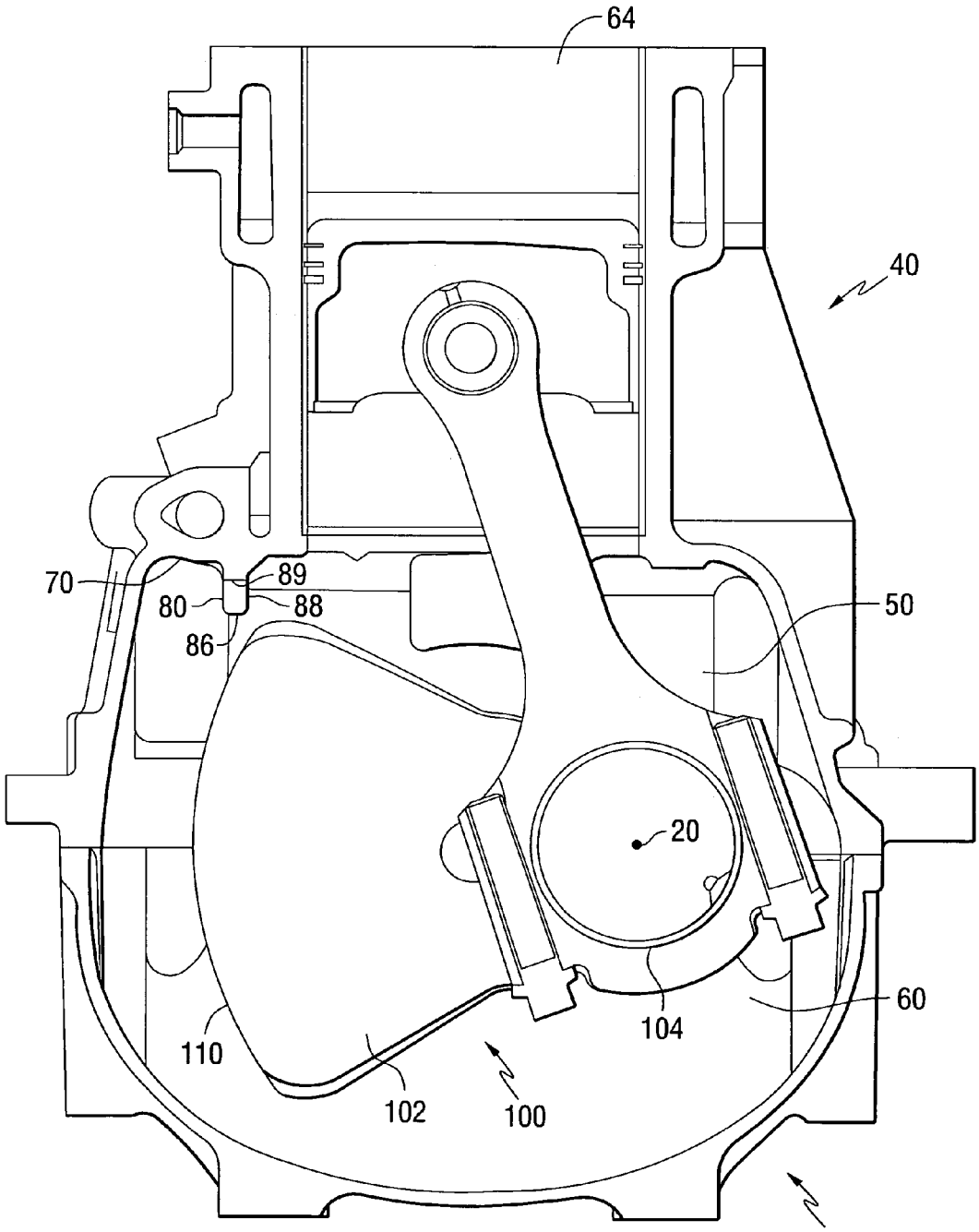
FIG. 6 is a section view taken through a marine engine to show the relationship between the present invention and a rotatable surface of a crankshaft.

FIG. 6 is a section view taken through a marine engine along a plane which is perpendicular to the axis of rotation 20 of the crankshaft 100. The crankshaft 100 is shown with its counterweight 102 extending radially from the crankshaft. As the crankshaft 100 rotates, the surface 110 moves along a generally circular path past the distal end 86 of the lubrication deflector 80. In a particularly preferred embodiment of the present invention, the distal end 86 of the lubrication deflector 80 is displaced from surface 110 by a distance which is generally in the range of three millimeters to seven millimeters. However, this range of distances is not limiting to the present invention. Depending on the operating conditions of the marine engine, the distal end 86 can be closer or farther from the relevant rotatable surface, such as surface 110, in order to urge the liquid lubrication to be separated from the crankshaft 100 and to flow toward the lubrication passage 70 which is formed as an integral part of the cylinder block 40.

With continued reference to FIG. 6, it can be seen that the first crankshaft supporting member 50 and the second crankshaft supporting member 60 cooperate with each other to support the crankshaft 100 for rotation about its axis of rotation 20.

As described above, it can be seen that a lubricating system for a marine engine made in accordance with a preferred embodiment of the present invention comprises a cylinder block 40 and a cover 10 which is attachable to the cylinder block 40 to define a crankcase therebetween. A first plurality of crankshaft supporting members 50 extend from the cylinder block 40. A second plurality of crankshaft supporting members 60 extend from the cover 10. A crankshaft 100 is supported for rotation about its axis of rotation 20 by the first and second plurality of crankshaft supporting members, 50 and 60, which are configured to cooperate with each other for this purpose. A plurality of deflectors 80 extend from the cylinder block 40 toward the crankshaft 100. A distal end 86 of each of the plurality of deflectors 80 is disposed proximate an associated rotating surface (e.g. surface 110) of the crankshaft 100. Each of the plurality of deflectors 80 is configured to direct a flow of lubricant away from the crankshaft 100, as represented by the arrow in FIG. 6, and each of the plurality of deflectors 80 is disposed between an associated pair of adjacent ones of the first plurality of crankshaft supporting members 50. In a preferred embodiment, each of the plurality of deflectors 80 is formed as an integral part of the cylinder block. A lubricant passage 70, is configured to conduct a flow of lubricant downwardly from each of the plurality of deflectors 80.

Although the present invention has been described in particular detail and illustrated to show a specific preferred embodiment, it should be understood that alternative embodiments are also within its scope. For example, the lubrication deflector need not be formed as an integral part of the cylinder block. In addition, the first and second portions of the distal ends of the lubrication deflectors need not be different from each other as described above.

I claim:

1. A lubricating system for a marine engine, comprising:

a cylinder block;

a crankcase cover which is attachable to said cylinder block to define a crankcase therebetween;

a first crankshaft supporting member extending from said cylinder block;

a second crankshaft supporting member extending from said crankcase cover;

a crankshaft, said first and second crankshaft supporting members being configured to cooperate with each other to support said crankshaft for rotation about a generally vertical axis of rotation; and a deflector extending from said cylinder block toward a rotatable surface which rotates with said crankshaft, a distal end of said deflector being disposed proximate said rotatable surface and configured to direct a flow of lubricant away from said rotatable surface;

said first crankshaft supporting member and said cylinder block being on a first side of said vertical axis of rotation of said crankshaft, said second crankshaft supporting member and said crankcase cover being on a second side of said vertical axis of rotation of said crankshaft, said first and second sides being distally opposite each other:

said deflector being on said first side of said vertical axis of rotation of said crankshaft.

2. The lubricating system of claim 1, wherein:

said deflector is formed as an integral part of said cylinder block.

3. The lubricating system of claim 1, further comprising:

a lubricant passage configured to conduct a flow of lubricant downwardly from a region of said deflector.

4. The lubricating system of claim 3, wherein:

said lubricant passage is formed as an integral portion of said cylinder block.

5. The lubricating system of claim 3, wherein:

said deflector is formed between said first crankshaft supporting member and said lubricant passage.

6. The lubricating system of claim 3, wherein:

said deflector is configured to direct said flow of lubricant toward said lubricant passage.

7. The lubricating system of claim 1, wherein:

a first portion of said distal end of said deflector is disposed proximate a first path traveled by a rotatable surface of a counterweight of said crankshaft as said crankshaft rotates about said generally vertical axis of rotation.

8. The lubricating system of claim 3, wherein:

a second portion of said distal end of said deflector is disposed proximate a second path traveled by a surface of a connecting rod attached to said crankshaft.

9. The lubricating system of claim 1, wherein:

said distal end of said deflector has upper and lower first portions spaced by a second portion therebetween.

10. The lubricating system of claim 1, wherein:

said crankshaft has at least one counterweight and at least one connecting rod portion rotating therewith;

said distal end of said deflector has a first portion separating said lubricant from said counterweight, and has a second portion separating said lubricant from said connecting rod portion.

11. The lubricating system of claim 1, wherein:

said crankshaft has at least a pair of upper and lower counterweights and at least one connecting rod portion therebetween and rotating with said crankshaft;

said distal end of said deflector has a pair of upper and lower first portions spaced by a second portion therebetween, said first portions separating said lubricant from respective said upper and lower counterweights of said pair of counterweights, said second portion separating said lubricant from said connecting rod portion.

12. A lubricating system for a marine engine, comprising:

a cylinder block;

a cover which is attachable to said cylinder block to define a crankcase therebetween;

a first plurality of crankshaft supporting members extending from said cylinder block;

a second plurality of crankshaft supporting members extending from said cover;

a crankshaft, each of said first plurality of crankshaft supporting members being configured to cooperate with an associated one of said second plurality of crankshaft supporting members to support said crankshaft for rotation about a generally vertical axis of rotation; and a plurality of deflectors extending from said cylinder block toward an associated rotatable surface which rotates with said crankshaft, a distal end of each of said plurality of deflectors being disposed proximate said associated rotatable surface, each of said plurality of deflectors being configured to direct a flow of lubricant away from said crankshaft;

said first plurality of crankshaft supporting members and said cylinder block being on a first side of said vertical axis of rotation of said crankshaft, said second plurality of crankshaft supporting members and said cover being on a second side of said vertical axis of rotation of said crankshaft, said first and second sides being distally opposite each other;

said plurality of deflectors being on said first side of said vertical axis of rotation of said crankshaft.

13. The lubricating system of claim 12, further comprising:

a lubricant passage configured to conduct a flow of lubricant downwardly from each of said plurality of deflectors.

14. The lubricating system of claim 13, wherein:

said lubricant passage is formed as an integral portion of said cylinder block.

15. The lubricating system of claim 14, wherein:

said lubricant passage is formed between said first crankshaft supporting member and a wall of said crankcase.

16. The lubricating system of claim 15, wherein:

each of said plurality of deflectors is configured to direct said flow of lubricant toward said lubricant passage.

17. The lubricating system of claim 16, wherein:

each of said plurality of deflectors is formed as an integral part of said cylinder block.

18. The lubricating system of claim 17, wherein:

a first portion of each of said distal ends of said plurality of deflectors is disposed proximate a first path traveled by an associated counterweight of said crankshaft as said crankshaft rotates about said generally vertical axis of rotation; and a second portion of each of said distal ends of said plurality of deflectors is disposed proximate a second path traveled by an associated connecting rod attached to said crankshaft as said crankshaft rotates about said generally vertical axis of rotation.

19. The lubricating system of claim 18, wherein:

each of said plurality of deflectors is disposed between an associated pair of adjacent ones of said first plurality of crankshaft supporting members.

20. A lubricating system for a marine engine, comprising:

a cylinder block;

a cover which is attachable to said cylinder block to define a crankcase therebetween;

a first plurality of crankshaft supporting members extending from said cylinder block;

a second plurality of crankshaft supporting members extending from said cover;

a crankshaft, each of said first plurality of crankshaft supporting members being configured to cooperate with an associated one of said second plurality of crankshaft supporting members to support said crankshaft for rotation about a generally vertical axis of rotation;

a plurality of deflectors extending from said cylinder block toward said crankshaft, a distal end of each of said plurality of deflectors being disposed proximate an associated rotating surface which rotates with said crankshaft, each of said plurality of deflectors being configured to direct a flow of lubricant away from said crankshaft, each of said plurality of deflectors being disposed between an associated pair of adjacent ones of said first plurality of crankshaft supporting members, each of said plurality of deflectors being formed as an integral part of said cylinder block; and a lubricant passage configured to conduct a flow of lubricant downwardly from each of said plurality of deflectors;

said first plurality of crankshaft supporting members and said cylinder block being on a first side of said vertical axis of rotation of said crankshaft, said second plurality of crankshaft supporting members and said cover being on a second side of said vertical axis of rotation of said crankshaft, said first and second sides being distally opposite each other;

said plurality of deflectors being on said first side of said first vertical axis of rotation of said crankshaft.

21. The lubricating system of claim 20, wherein:

a first portion of each of said distal ends of said plurality of deflectors is disposed proximate a first path traveled by an associated counterweight of said crankshaft as said crankshaft rotates about said generally vertical axis of rotation.

22. The lubricating system of claim 21, wherein:

a second portion of each of said distal ends of said plurality of deflectors is disposed proximate a second path traveled by an associated connecting rod attached to said crankshaft as said crankshaft rotates about said generally vertical axis of rotation.

23. The lubricating system of claim 20, wherein:

each of said plurality of deflectors is configured to direct said flow of lubricant toward said lubricant passage.

* * * * *